US006309699B2

(12) United States Patent
Kawaura et al.

(10) Patent No.: US 6,309,699 B2
(45) **Date of Patent: *Oct. 30, 2001**

(54) METHOD OF PRODUCING A METALLIC PART EXHIBITING EXCELLENT OXIDATION RESISTANCE

(75) Inventors: Hiroyuki Kawaura; Hiroshi Kawahara; Takashi Saito; Kazuaki Nishino; Nobuhiko Matsumoto; Tadahiko Furuta, all of Aichi (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/255,035

(22) Filed: Feb. 22, 1999

(30) Foreign Application Priority Data

| | | |
|---|---|---|
| Feb. 20, 1998 | (JP) | 10-039356 |
| May 11, 1998 | (JP) | 10-127744 |
| Feb. 17, 1999 | (JP) | 11-038241 |

(51) Int. Cl.[7] ..... B05D 1/12
(52) U.S. Cl. ..... 427/191; 427/201; 427/242
(58) Field of Search ..... 427/180, 191, 427/201, 205, 242, 11, 624; 148/537, 516

(56) References Cited

U.S. PATENT DOCUMENTS

| | | | |
|---|---|---|---|
| 3,617,360 | * | 11/1971 | Levine . |
| 4,178,193 | * | 12/1979 | Kanter . |
| 4,552,784 | * | 11/1985 | Chu et al. . |

FOREIGN PATENT DOCUMENTS

| | | | |
|---|---|---|---|
| 60-63364 | | 4/1985 | (JP) . |
| 60-100659 | | 6/1985 | (JP) . |
| 4-198408 | * | 7/1992 | (JP) . |
| 4-254597 | | 9/1992 | (JP) . |
| 5-86443 | | 4/1993 | (JP) . |
| 5-156423 | | 6/1993 | (JP) . |
| 5-345942 | | 12/1993 | (JP) . |
| 6-93412 | | 4/1994 | (JP) . |
| 08-333671 | * | 12/1996 | (JP) . |
| 9-256138 | | 9/1997 | (JP) . |
| 10-30190 | | 2/1998 | (JP) . |

OTHER PUBLICATIONS

Hawley's Condensed Chemical Dictionary, 13th Ed. p. 613, 1997.*

Kirk–Othmer Encyclopedia of Chemical Technology, 4th Edition, vol. 24, 198–201, 217, 1997.*

* cited by examiner

*Primary Examiner*—Fred J. Parker
(74) *Attorney, Agent, or Firm*—Oblon, Spivak, McClelland, Maier & Neustadt, P.C.

(57) ABSTRACT

The invention provides a method of producing an oxidation-resistant metallic part which exhibits oxidation resistance even in an oxidation atmosphere. The method includes the step of applying mechanical energy to a surface of a metallic part in the presence of particulates, and forming a protective coating in a surface of the metallic part. When the metallic part thus treated is exposed in a high temperature-oxidation atmosphere, the protective coating is oxidized to restrain the proceeding of the oxidation of the metallic part, that is the internally proceeding formation of $TiO_2$, thus serving a remarkable improvement of the oxidation resistance.

17 Claims, 2 Drawing Sheets

Microstructure

METHOD OF PRODUCING A METALLIC PART EXHIBITING EXCELLENT OXIDATION RESISTANCE

BACKGROUND OF THE INVENTION

1. Field of the Invention

The present invention relates to a method of producing metal members which exhibit excellent oxidation resistance.

2. Description of the Related Art

Conventionally, it has been proposed to form protective coatings in surfaces of metal materials for improving the oxidation resistance thereof at elevated temperatures without lowering their mechanical characteristics and excellent properties such as good workability. As the method of forming these protective coatings, surface treatments such as plating, pack-cementation, vacuum-deposition or spraying process have been used, for example.

The surface treatment, however, has problems such as equipment being expensive, long treating time being required, intersurfaces existing between substrates and coating layers to cause peeling of the coating layers from the substrates, resulting in shortage of adhesion therebetween, and distortions and dimensional changes being generated in products due to the surface treatment.

To improve the oxidation resistance of Ti-based alloy, for example, at elevated temperatures of 600° C. or more, the Ti-based alloy having a protective coating in a surface thereof has been proposed.

Japanese Patent application laid-open No. Hei 4-254597, for example, has the object of improving the adhesion and oxidation resistance, and discloses a coating composed of a ductile alloy expressed by MCrAl or MCr (Fe, Ni, Co).

Japanese Patent application laid-open No. Hei 5-345942 discloses a Ti-based alloy exhibiting oxidation resistance at elevated temperatures, of which the surface is improved by implanting ions of at least one of elements of Group Vb of the periodic table, such as phosphorus, arsenic and antimony, into an Al-containing Ti-based alloy.

Furthermore, Japanese Patent applications laid-open Nos. Hei 5-156423 and Hei 6-93412 disclose Al-Cr composite diffusion coatings, and Japanese Patent application laid-open No. Hei 9-256138 discloses a Ti-based alloy exhibiting excellent oxidation resistance and abrasion resistance, which has an Al and N-containing coating in a surface thereof.

The coating disclosed in Japanese Patent application laid-open No. Hei 4-254597 exhibits a certain degree of oxidation resistance, but does not exhibit satisfactorily good oxidation resistance. As the method of forming this coating, plasma-spraying process has been recommended, but, generally, the plasma-spraying process has defects such as (1) the treatment costs being expensive, (2) voids existing within a resultant coating to make it difficult to restrict the oxygen diffusion into a substrate, (3) adhesion between the coating and substrate being weak, and the coefficient of thermal expansion of the coating differing from that of the substrate, which result in the stability of the coating becoming worse after subjected to repeated oxidation of heating and cooling cycles.

The protective coating disclosed in Japanese Patent application laid-open No. Hei 5-345942 does not exhibit satisfactorily good oxidation resistance under severe oxidation conditions. This protective coating is formed by ion-implantation. This method, however, makes it difficult to perform the surface treatment of parts having complicated configurations.

The coatings disclosed in Japanese Patent applications laid-open Nos. Hei 5-156423 and Hei 6-93412 are formed by diffusion treatment. However, since the treating temperature ranges from 700° C. to 1300° C., this treatment has problems such as (1) dimensional changes of resultant parts being great, and (2) substrates being exposed to the temperature above the $\alpha-\beta$ transformation temperature thereof to decrease the mechanical properties thereof.

Furthermore, with the coating disclosed in Japanese Patent application laid-open No. Hei 9-256138, the evaluation test temperature is low so that the oxidation resistance at elevated temperatures which are more severe conditions cannot be ensured. Examples of the method of forming this coating include ion-plating, sputtering, vacuum deposition, ion-implantation and CVD treatment, but, generally, these methods are expensive in treatment costs, and are not suited to the uniform surface treatment of parts having complicated configurations.

Furthermore, as the method of improving the oxidation resistance of iron-based alloy and nickel-based alloy, Japanese Patent application laid-open No. Sho 60-63364, for example, discloses the method of plating steel plates with aluminum and subjecting the aluminum-plated steel plates to the diffusion heat treatment to form coatings in surfaces thereof and improve the oxidation resistance of the steel plates.

Japanese Patent application laid-open No. Sho 60-100659 discloses that oxidation-resistant protective coatings exhibiting excellent durability are formed by plating a cast-iron member with nickel and aluminum, and subjecting the plated member to the diffusion heat treatment.

In addition to these treatments, plasma-spraying process, vacuum-deposition, ion-implantation, CVD treatment and PVD treatment are known as the method of forming the protective coatings.

The aluminum-coating treatments disclosed in Japanese patent applications laid-open Nos. Sho 60-63364 and 60-100659, however, have problems such as (1) the material coatable with aluminum being limited, (2) substrates being degraded due to the treatment at elevated temperatures, and (3) resultant coatings lacking stability over a long period due to repeated oxidation at elevated temperatures.

Furthermore, as described above, the plasma-spraying process has problems such as (1) the treatment costs being expensive, (2) voids existing within resultant coatings making it difficult to restrict the diffusion of oxygen into substrates, (3) adhesion between coatings and substrates being weak, and the coefficient of thermal expansion of the coatings differing from that of the substrates, which result in the stability of the protective coatings becoming worse against repeated oxidation of heating and cooling cycles.

In addition, ion-plating, sputtering, vacuum-deposition, ion-implantation, CVD treatment, and PVD treatment have problems such as uniform surface treatment of parts having complicated configurations being difficult, and the treatment costs being very expensive.

Furthermore, as another surface treatment of metal materials, Japanese Patent application-laid open No. Hei 10-30190 discloses a surface-improving method of metal. With the method of Japanese Patent application-laid open No. Hei 10-30190, by applying mechanical energy to surfaces of the metal in the presence of particulates of the material different from that of the metal, mechanically alloyed layers of elements composing the metal and particulates are formed.

However, with the surface treatment of metal, which is disclosed in Japanese Patent application laid-open No. Hei 10-30190, the mechanically alloyed layer formed in the surface of the metal is in a non equilibrium phase which is a metastable state like an amorphous phase or supersaturated solid solution phase so that elements contained in the metal, of which the oxidation rates are higher, are selectively oxidized with ease so that the mechanically alloyed layer has not operated sufficiently as an oxidation-resistant protective coating in an oxidation atmosphere.

SUMMARY OF THE INVENTION

It is an object of the present invention to provide a method of producing oxidation-resistant metal which exhibit sufficiently good oxidation resistance even in an oxidation atmosphere.

The present inventors have investigated the method of forming a protective coating which is stable in a high temperature-oxidation atmosphere, in a surface of a metal. And, they have found that the above-described object can be attained by forming a protective coating in the surface of the metal such that at least one part of particulates are dispersed to become one body with the metal while being connected to each other.

With one method of producing a metal which exhibits excellent oxidation resistance in accordance with the present invention, mechanical energy is applied to a surface of a metallic part of a Ti-based alloy which contains less than 9 wt % of aluminum (Al) and titanium (Ti) as a remainder, in the presence of particulates containing at least one element of molybdenum (Mo), niobium (Nb) silicon (Si), tantalum (Ta) tungsten (W) and chromium (Cr) to form a protective coating in the vicinity of the surface of said metallic part, at least one part of said particulates being dispersed in said protective coating.

With another method of producing a metal which exhibits excellent oxidation resistance in accordance with the present invention, mechanical energy is applied to a surface of a metallic part of Ti-based alloy in the presence of particulates containing at least one element of yttrium (Y), zirconium (Zr), lanthanum (La), cerium (Ce) and hafnium (Hf), to form a protective coating in the vicinity of the surface of said metallic part, at least one part of said particulates being dispersed in said protective coating.

With still another method of producing a metals which exhibits excellent oxidation resistance in accordance with the present invention, mechanical energy is applied to a surface of a metal composed of an iron-based alloy or a nickel-based alloy in the presence of particulates containing at least one element of Al, Si, Cr, Nb, W, Mo, Ta, La, Ce and Y, to form a protective coating in the vicinity of the surface of said metallic part, at least one part of said particulates being dispersed in said protective coating.

With these methods of producing metals, each exhibiting excellent oxidation resistance, in accordance with the present invention, protective coatings are formed such that at least one part of particulates are dispersed in the metals and are connected to each other in the vicinity of the surfaces of the metals.

The above-mentioned particulates which are dispersed in the vicinity of the surface of the metal may react with the element which constitutes the above-mentioned metallic part to form an alloy on the surface of the particulates.

In accordance with the present invention, the rates expressed as wt % denote that of additive to a resultant alloy containing the same.

Al-containing Ti-based alloy

One method of producing metals in accordance with the present invention is the method of producing metals composed of Al-containing Ti-based alloy, which includes the step of applying mechanical energy to a surface of a metal composed of Ti-based alloy containing less than 9 wt % of aluminum (Al) and titanium (Ti) as the remainder in the presence of particulates containing at least one element of Mo, Nb, Si, Ta, W and Cr to form a protective coating such that at least one part of the particulates are dispersed in the vicinity of the surface of Ti-based alloy.

It is preferable that the particulates dispersed in the protective coating are connected to each other. With this structure, a dense protective coating is formed, and consequently, the proceeding of the formation of oxides in the protective coating can be restrained.

It is preferable to use the Ti-based alloy which contains less than 9 wt %, and more preferably more than 1 wt % and less than 9 wt %, of Al.

Al is an α-stabilization element in the Ti-based alloy and raises the transformation temperature from α phase to β phase (β transus temperature). With the addition of Al to the Ti-based alloy, α phase thereof becomes stable even in the elevated temperature range, and the high-temperature strength and creep strength are improved. When the Al content is 1 wt % or less, the stabilization effect of α phase is a little, and the improvement of the high-temperature strength and creep strength due to the solid solution of Al is unfavorable, and thus not sufficient. And when the Al content is 9 wt % or more, the Ti-based alloy becomes a single phase of $Ti_3Al$ intermetallic compound which is unfavorably brittle. The more preferred Al content ranges from 4.0 to 6.5 wt %.

It is preferable that the Ti-based alloy contains 0.5 to 10 wt % of 10 wt % of V. V is a β-stabilization element in the Ti-based alloy, and acts to restrict the formation of brittle $Ti_3Al$ intermetallic compound when Al is added to the Ti-based alloy. The more preferred V content ranges from 2.0 to 6.5 wt %.

It is preferable that the Ti-based alloy contains 0.5 to 6.0 wt % of Zr. Zr is a neutral element, but acts to strengthen α phase of the Ti-based alloy as a solid solution, similarly to Al, and serves to improve the high-temperature strength and creep strength. When the Zr content is less than 0.5 wt %, the improvement of the strength due to the stabilization of α phase is a little, and when the Zr content exceeds 6.0 wt %, the Ti-based alloy becomes unfavorably brittle. The more preferred Zr content ranges from 2.5 to 4.5 wt %.

It is preferable that the Ti-based alloy contains 0.5 to 3.0 wt % of Mo. Mo is a β-stabilization element in the Ti-based alloy, and acts to deposit α-phase finely and serves to the improvement of the strength, particularly the fatigue strength, in the middle and low temperature ranges. When the Mo content is less than 0.5 wt %, the improvement of the strength is not sufficient, and when the Mo content exceeds 3.0 wt %, βphase increases, and the high-temperature strength, creep strength and toughness unfavorably decrease. The more preferred Mo content ranges from 0.5 to 1.5 wt %.

It is preferable that the Ti-based alloy contains 0.5 through 4.5 wt % of Nb. Nb is a β-stabilization element in the Ti-based alloy, acts to keep the hot strength-toughness balance thereof in combination with Mo, and serves to the improvement of the oxidation resistance. When the Nb content is less than 0.5 wt %, the improvement of the strength is not sufficient, and when the Nb content exceeds 4.5 wt %, β phase increases, and the hot strength, creep strength and toughness decrease so as to be less preferable. The more preferred Nb content ranges from 0.5 to 1.5 wt %.

It is preferable that the Ti-based alloy contains 0.1 through 1.0 wt % of Si. Si is an element which improves the creep characteristics as a solid solution and serves to the improvement of the oxidation resistance. The preferred Si content is 1.0 wt % or less. When the Si content exceeds 1.0 wt %, the ductility of the Ti-based alloy is unfavorably damaged.

By using the Ti-based alloys having the above-described composition, protective coatings can be readily formed in the vicinity of the surfaces thereof at low costs.

The Ti-based alloys to which the method of the present invention is applied may be formed into arbitrary configurations by casting, forging, cutting, rolling or the like after any melting step or sintering step of raw materials.

The mechanism that the metals of the oxidation-resistant Al-containing Ti-based alloy exhibit excellent characteristics has not been sufficiently clarified, but can be considered as follows.

When the particulates are collided against the Al-containing Ti-based alloy by applying mechanical energy thereto, the particulates adhere to the surface of the Ti-based alloy to generate impact compression, and consequently, a surface section mainly composed of elements defining the particulates is formed with the generated impact compression. More specifically, one part of the particulates adhering to the surface of the Al-containing Ti-based alloy are partly dispersed inside thereof due to the impact compression, and dispersed particulates are connected to each other to define a layer, thus acting as the protective coating. This protective coating restrains the proceeding of the oxidation of the Ti-based alloy, that is the internally proceeding formation of $TiO_2$, thus remarkably improving the oxidation resistance. It can be considered that this mechanism enables the protective coating exhibiting excellent oxidation resistance to be formed in the surface of the Al-containing Ti-based alloy readily and at low costs.

The particulates to be dispersed inside the Al-containing Ti-based alloy may have a dispersed state themselves. Namely, they may have the state which enables one part of them to be embedded in the Al-containing Ti-based alloy upon adhering thereto.

The above-mentioned particulates which are dispersed in the vicinity of the surface of the metal may react with the element which constitutes the above-mentioned metallic part to form an alloy on the surface of the particulates.

The method of applying mechanical energy to the surface of the Al-containing Ti-based alloy in the presence of the particulates requires to apply the mechanical energy sufficient to enable the particulates to form a coating in the surface of the Al-containing Ti-based alloy. Examples of such a method include the method of striking particulates repeatedly at a high rate, such as shot-blasting or shot-peening, and the method of rotating a container in which an Al-containing Ti-based alloy, particulates and hard balls are put, such as the method of using a planetary ball mill or ball mill.

When the particulates are sprayed at a high rate, as an example, for applying mechanical energy to the particulates, the preferred spraying rate of the particulates ranges from 20 to 240 m/sec. When the spraying rate of the particulates is less than 20 m/sec, the particulates are difficult to adhere to the surface of a substrate, and when the spraying rate of the particulates exceeds 240 m/sec, the surface state of the substrate may unfavorably be damaged. As long as the spraying rate is in this range, coatings can be formed in surfaces of the Al-containing Ti-based alloys.

The mechanical energy to be applied with the method of rotating the container, such as the method using the planetary ball mill, is not determined specifically, because such mechanical energy varies with the volume or the like of the container. But, when the container having an inner diameter of 10 cm, height of 7 cm and volume of 500 ml is used, the preferred number of rotations ranges from 20 to 2400 rpm. When the number of rotations is less than 20 rpm, the particulates are difficult to adhere to the surface of the metal. When the number of rotations exceeds 2400 rpm, the surface state of the metal member may unfavorably be damaged. As long as the number of rotations is in this range, coatings can be formed in surfaces of the metals.

It is preferable to perform the treatment of applying mechanical energy to the surface of the Al-containing Ti-based alloy in an inert gas such as argon. Alternatively, such treatment may be performed in the air.

The preferred diameter of the particulates ranges from 5 to 300 μm. When the diameter of the particulates is less than 5 μm, the handling of such fine particulates is troublesome, and when the diameter exceeds 300 μm, the particulates become unfavorably difficult to adhere to the surface of the Ti-based alloy.

It is preferable that the particulates are used as a metal powder, alloy powder, oxide powder, or a mixture thereof, each containing at least one element of Mo, Nb, Si, Ta, W and Cr. It is preferable that the particulates exist in the surface of the metal as powder. But, the particulates may be in a form of film, gas or liquid.

It is preferable that the coating formed in the surface of the Al-containing Ti-based alloy in accordance with the present invention is subjected to the heat treatment prior to using at elevated temperatures. This heat treatment enables the promotion of the formation of the layer which exhibits excellent oxidation resistance.

Ti-based alloy

Another method of producing metals in accordance with the present invention is the method of producing metals composed of Ti-based alloy, which includes the step of applying mechanical energy to a surface of a member of Ti-based alloy in the presence of particulates containing at least one element of Y, Zr, La, Ce and Hf to form a protective coating wherein particulates are partly dispersed.

It is preferable that the particulates dispersed in the protective coating are connected to each other. With this structure, a dense protective coating is formed, and consequently, the proceeding of the formation of oxides in the protective coating can be restrained.

The Ti-based alloy may contain Al or not. The amount of Al to be contained in the Ti-based alloy is not limited specifically. But, the preferred Al content is less than 9 wt %, like the case of the Al-containing Ti-based alloy.

Al is an α-stabilization element in the Ti-based alloy and raises the temperature where α phase is transformed to β phase (β transas temperature). With the addition of Al to the Ti-based alloy, α phase becomes stable even in the elevated temperature range, and the hot strength and creep strength are improved. When the Al content is 1 wt % or less, the stabilization effect of α phase is a little, and the improvement of the hot strength and creep strength due to the solid solution of Al is unfavorably not sufficient. And when the Al content is 9 wt % or more, the Ti-based alloy becomes a single phase of $Ti_3Al$ intermetallic compound which is unfavorably brittle. The more preferred Al content ranges from 4.0 to 6.5 wt %.

It is preferable that the Ti-based alloy contains 0.5 to 10 wt % of V. V is β -stabilization element in the Ti-based alloy, and acts to restrict the formation of brittle $Ti_3Al$ intermetallic compound when Al is added to the Ti-based alloy. The more preferred V content ranges from 2.0 to 6.5 wt %.

It is preferable that the Ti-based alloy contains 0.5 to 6.0 wt % of Zr. Zr is a neutral element, but acts to strengthen α phase of the Ti-based alloy as a solid solution, similarly to the case of Al, thus serving the improvement of the hot strength and creep strength. When the Zr content is less than 0.5 wt %, the improvement of the strength due to the stabilization of α phase is a little, and when the Zr content exceeds 6.0 wt %, the Ti-based alloy becomes unfavorably brittle. The more preferred Zr content ranges from 2.5 to 4.5 wt %.

It is preferable that the Ti-based alloy contains 0.5 to 3.0 wt % of Mo. Mo is a β-stabilization element of the Ti-based alloy, acts to deposit α phase finely and serves the improvement of the strength, particularly the fatigue strength, in the middle and low temperature ranges. When the Mo content is less than 0.5 wt %, the improvement of the strength is not sufficient, and when the Mo content exceeds 3.0 wt %, β phase increases and the high-temperature strength, creep strength and toughness unfavorably decrease. The more preferred Mo content ranges from 0.5 to 1.5 wt %.

It is preferable that the Ti-based alloy contains 0.5 to 4.5 wt % of Nb. Nb is a β-stabilization element of the Ti-based alloy, acts to maintain the hot strength-toughness balance in combination with Mo, and serves the improvement of the oxidation resistance. When the Nb content is less than 0.5 wt %, the improvement of the strength is not sufficient, and when the Nb content exceeds 4.5 wt %, β phase increases and the hot strength, creep strength and toughness unfavorably decrease. The more preferred Nb content ranges from 0.5 to 1.5 wt %.

It is preferable that the Ti-based alloy contains 0.1 to 1.0 wt % of Si. Si is an element which improves the creep characteristics as a solid solution and serves the improvement of the oxidation resistance. The preferred Si content is 1.0 wt % or less. When the Si content exceeds 1.0 wt %, the ductility of the Ti-based alloy is unfavorably damaged.

By using the Ti-based alloys having the above-described composition, protective coatings wherein oxidation-resistant particulates are dispersed can be readily formed in the surfaces thereof at low costs.

The Ti-based alloys to which the method of the present invention is applied may have arbitrary configurations by casting, forging, cutting, rolling or the like after any melting step or sintering step of raw materials.

The mechanism the metals of oxidation-resistant Al-containing Ti-based alloys exhibit excellent effect has not been sufficiently clarified, but can be considered as follows.

When the particulates are collided against the Ti-based alloy by applying mechanical energy thereto, the particulates adhere to the surface of the Ti-based alloy to generate impact compression, and consequently, a surface section mainly composed of elements defining one particulates is formed with the generated impact compression. This surface section has the structure that the particulates adhering to the surface of the Ti-based alloy are partly dispersed, and connected to each other to define a layer, thus acting as the protective coating. This protective coating restrains the proceeding of the oxidation of the Ti-based alloy, that is the internally proceeding formation of $TiO_2$, thus remarkably improving the oxidation resistance. It can be considered that this mechanism enables the protective coating which exhibits excellent oxidation resistance to be formed in the surface of the Ti-based alloy readily and at low costs.

The particulates to be dispersed inside the Al-containing Ti-based alloy may have a dispersed state themselves. Namely, they may have the state which enables one part of them to be embedded in the Al-containing Ti-based alloy upon adhering thereto.

The above-mentioned particulates which are dispersed in the vicinity of the surface of the metal may react with the element which constitutes the above-mentioned metallic part to form an alloy on the surface of the particulates.

The method of applying mechanical energy to the particulates requires to apply the mechanical energy sufficient to enable the particulates to form a coating in the surface of the Ti-based alloy. Examples of such a method include the method of striking particulates repeatedly at a high rate, such as shot-blasting or shot-peening, and the method of rotating a container in which the Ti-based alloy, particulates and hard balls are put, such as the method using a planetary ball mill or ball mill.

When the particulates are sprayed at a high rate, as one example for applying mechanical energy to the particulates, the preferred spraying rate of the particulates ranges from 20 to 240 m/sec. When the spraying rate of the particulates is less than 20 m/sec, the particulates are difficult to adhere to the surface of a substrate, and when the spraying rate of the particulates exceeds 240 m/sec, the surface state of the substrate may unfavorably be damaged. As long as the spraying rate is in this range, coatings can be formed in surfaces of the Ti-based alloys. In order to promote the adhering and securing of the particulates, steel balls, ceramics powder or the like may be mixed therewith and sprayed onto the surface of the Ti-based alloy.

The mechanical energy to be applied with the method of rotating the container, such as the method using the planetary ball mill, is not determined specifically, because such mechanical energy varies with the volume or the like of the container. But, when the container having an inner diameter of 10 cm, height of 7 cm and volume of 500 ml is used, the preferred number of rotations ranges from 20 to 2400 rpm. When the number of rotations is less than 20 rpm, the particulates are difficult to adhere to the surface of the metal. When the number of rotations exceeds 2400 rpm, the surface state of the metal may unfavorably be damaged. As long as the number of rotations is in this range, coatings can be formed in surfaces of the metals.

It is preferable to perform the treatment of the Ti-based alloy with the particulates to which mechanical energy is applied in an inert gas such as argon. Alternatively, such treatment may be performed in the air.

The particulates may be a metal powder, alloy powder, oxide powder or a mixture thereof, each containing Y, Zr, La, Ce and Hf.

The preferred diameter of the particulates ranges from 5 to 300 μm. When the diameter of the particulates is less than 5 μm, the handling of such fine particulates is troublesome, and when the diameter exceeds 300 μm, the particulates become unfavorably difficult to adhere to the surface of the Ti-based alloy.

It is preferable that the coating formed in the surface of the Ti-based alloy is subjected to the heat treatment prior to using at elevated temperatures. This heat treatment promotes the formation of the layer which exhibits excellent oxidation resistance.

Iron-based alloy or nickel-based alloy

Still another method of producing metal members in accordance with the present invention includes the step of applying mechanical energy to a surface of a member of iron-based alloy or a member of nickel-based alloy in the presence of particulates containing at least one element of Al, Si, Cr, Nb, W, Mo, Ta, La, Ce and Y to form a protective coating wherein particulates are partly dispersed.

It is preferable that the particulates dispersed in the protective coating are connected to each other. With this structure, a dense protective coating is formed, and consequently, the proceeding of the formation of oxides in the protective coating can be restrained.

The mechanism of the formation of the protective coating is as follows.

When the particulates are collided against the iron-based alloy or nickel-based alloy by applying mechanical energy thereto, the particulates adhere to the surfaces of the iron-based alloy or nickel-based alloy to generate impact compression, and consequently, surface sections mainly composed of elements defining the particulates are formed with the generated impact compression. More specifically, the particulates adhering to the surfaces of the iron-based alloy or nickel-based alloy are partly dispersed inside thereof, and connected to each other to define layers, thus acting as the protective coatings. These protective coatings restrain the proceeding of the oxidation of the iron-based alloy or nickel-based alloy, that is the internally proceeding formation of oxides, thus remarkably improving the oxidation resistance. It can be considered that this mechanism enables the protective coatings which exhibit excellent oxidation resistance to be formed in the surfaces of the iron-based alloy or nickel-based alloy readily and at low costs.

The particulates to be dispersed inside the iron-based alloy or nickel-based alloy may have a dispersed state themselves. Namely, they may have the state which enables one part of them to be embedded in the iron-based alloy or nickel-based alloy upon adhering thereto.

The above-mentioned particulates which are dispersed in the vicinity of the surface of the metal may react with the element which constitutes the above-mentioned metallic part to form an alloy on the surface of the particulates.

It is preferable that the iron-based alloy and nickel-based alloy contain at least one element of Al, Si and Cr. Examples of the iron-based alloy include cast iron, steel, stainless steel and heat-resistant steel, each containing iron as a main ingredient, and examples of the nickel-based alloy include a nickel-based heat-resistant alloy.

When at least one of Al, Si and Cr are contained in the particulates, Al, Si and Cr in a metal substrate of the iron-based alloy or nickel-based alloy, and the particulates form a dense protective coating which exhibits excellent adhesion properties, thus improving the oxidation resistance. Particularly, when an alloy with at least one element of silicon, niobium, tungsten, molybdenum, tantalum, lanthanum, cerium, yttrium is used, a protective coating which exhibits remarkably good oxidation resistance and excellent adhesion can be formed.

When the amount of silicon, aluminum and chromium contained in the metal substrate is small, it is preferable that the above-described particulates to be applied to the surface of the substrate contain silicon, aluminum and chromium.

Furthermore, where the metal substrate contains at least one element of Al, Si and Cr, a metal which exhibits excellent oxidation resistance can be produced by using the particulates containing at least one element of Al, Si and Cr.

More specifically, when the metal formed with the method in accordance with the present invention is exposed to elevated temperatures of 500° C. or more, Al, Si and Cr contained in the metal substrate and Al, Si and Cr composing the particulates form a protective coating having a high concentration of oxides of $Al_2O_3$, $SiO_2$ and $Cr_2O_3$ in the surface of the metal substrate, and consequently, the diffusion of oxygen in the protective coating at elevated temperatures is restrained to enhance the oxidation resistance of the metals.

Furthermore, where the metal substrate contains at least one element of Al, Si and Cr, a metal exhibiting excellent oxidation resistance can be formed by using the particulates containing at least one element of Nb, W, Mo, Ta, La, Ce and Y.

More specifically, when the protective coating formed in the surface of the metal with the method in accordance with the present invention is exposed to an elevated temperature atmosphere of 500° C. or more, at least one element of Nb, W, Mo, Ta, La, Ce and Y dissolves in the coating of at least one of $Al_2O_3$, $SiO_2$ and $Cr_2O_3$ which are formed with at least one element of Al, Si and Cr contained in the metal substrate, as a solid solution, or makes composite oxides therewith, thus forming a protective coating. With a resultant protective coating, the diffusion of oxygen in the coating slows down further, as compared to the cases of the above-described coating of $Al_2O_3$, $SiO_2$ and $Cr_2O_3$, and the adhesion with the metal substrate is improved, whereby the oxidation resistance of the metal substrate is further improved.

The application of the particulates to the surface of the metal substrate is performed by applying mechanical energy to the particulates. More specifically, there are methods of colliding particulates repeatedly at a high rate, such as shot-blasting and shot-peening, and rotating a container of a planetary ball mill and ball mill, in which the metal substrate, particulates and hard balls are put. By colliding the particulates against the metal substrate repeatedly, the particulates are dispersed in the surface of the metal substrate, and oxidized in an elevated temperature atmosphere to become one body with the metal substrate, thus forming a protective coating which exhibits high adhesion.

The preferred spraying rate of the particulates for spraying the particulates onto the surface of the metal substrate ranges from 20 to 240 m/sec. When the spraying rate of the particulates is less than 20 m/sec, the particulates are difficult to adhere to the surface of the substrate, and when the spraying rate of the particulates exceeds 240 m/sec, the surface state of the substrate may unfavorably be damaged. As long as the spraying rate is in this range, the particulates adhere and are secured to the surface of the substrate, thus enabling the formation of a protective coating containing elements of particulates. To promote the adhesion and securing of particulates, steel balls, ceramic powder and the like may be mixed with the particulates and sprayed onto the surface of the substrate.

The mechanical energy to be applied with the method of rotating the container, such as the method using the planetary ball mill, is not determined specifically, because such mechanical energy varies with the volume or the like of the container. But, when the container having an inner diameter of 10 cm, height of 7 cm and volume of 500 ml is used, with the number of rotations of 20 to 2400 rpm, sufficient mechanical energy to form a protective coating can be applied. When the number of rotations is less than 20 rpm, the particulates are difficult to adhere to the surface of the metal member. When the number of rotations exceeds 2400 rpm, the surface state of the metal member may unfavorably be damaged. As long as the number of rotations is in this range, coatings can be formed in surfaces of the metals.

It is preferable to perform the treatment of applying particulates in an inert gas or in a vacuum. Alternatively, such treatment may be performed in the air. The particulates may be a metal powder, alloy powder, oxide powder, or a composite powder thereof, each containing the above-described elements.

The preferred diameter of the particulates ranges from 5 to 300 $\mu$m. When the diameter of the particulates is less than 5 $\mu$m, the handling of such fine particulates is difficult, and when the diameter exceeds 300 $\mu$m, the particulates become unfavorably difficult to adhere to the surface.

It is preferable to perform the heat treatment, as required, after the particulates are applied to the surface of the metal substrate, thus forming an oxide protective coating previously. This heat treatment may be performed at the temperature when the metal member is actually used. The preferred temperature of such heat treatment ranges from 500 to 900° C.

Other objects, features, and characteristics of the present invention will become apparent upon consideration of the following description and the appended claims with reference to the accompanying drawings, all of which form a part of this specification.

DETAILED DESCRIPTION OF THE PREFERRED EMBODIMENTS

Figure 1:
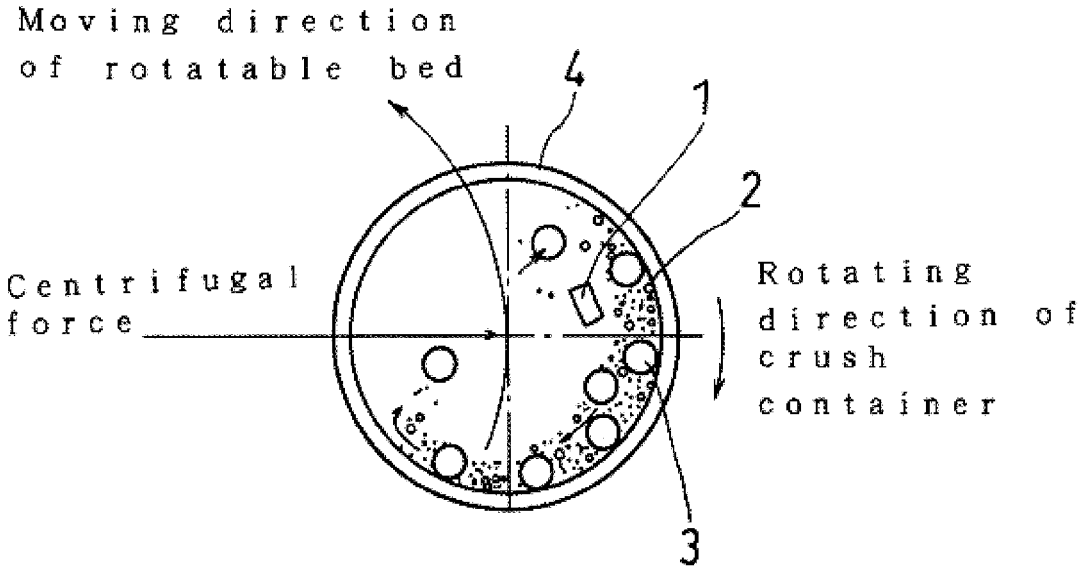
FIG. 1 is a diagram illustrating the interior of a container of a planetary ball mill employed for applying mechanical energy in a third embodiment of a method in accordance with the present invention.

Hereinafter, the present invention will be explained based on several embodiments.

First Embodiment

Material to be treated

Ingots of various Ti-based alloys having chemical compositions shown in TABLE 1 were formed by melting, and cut to prepare test pieces, each having a plate-like configuration with dimensions of 15×10×3 (mm).

Then, a surface of each test piece was ground with a SiC paper of No. 1500, and degreased with acetone.

Surface treatment

Powders of $SiO_2$, $Cr_2O_3$, $Y_2O_3$, $ZrO_2$, $Nb_2O_5$, $MoO_3$, $La_2O_3$, $CeO_2$, $HfO_2$, $Ta_2O_5$ and $WO_3$, each having a particle diameter of 5 to 200 $\mu$m, were prepared, and a surface section of each test piece of the Ti-based alloy was subjected to shot-blasting in the air by using the prepared powders. The mechanical energy applied was 4 kgf/cm$^2$ as the spraying pressure of powders, which corresponds to the spraying rate of 100 m/sec. Due to this treatment, a protective coating adhered to each test piece by about 5 $\mu$m.

More specifically, particulates were sprayed onto surfaces of plate-like test pieces Ti-based alloy with dimensions of 15×10×3 mm repeatedly from a nozzle having a diameter of 5 mm with the compressed air of a spraying pressure of 4 kgf/cm$^2$ by means of a device for use in shot-blasting. The distance from a tip end of the nozzle to each test piece was 100 mm and the treatment time was 1 minute.

(Oxidation resistance test)

Oxidation resistance of each of the plate-like test pieces obtained with the above-described surface treatment was evaluated with the following method.

The test pieces were heated with a resistance heating electric furnace at 700° C. or 800° C. for 200 hours in the air, as shown in TABLE 1. During testing, the test pieces were heated within crucibles of $Al_2O_3$. Then, the test pieces were collected along with peeled coatings. The weight gain due to oxidation was measured to evaluate the oxidation resistance thereof. The test results are also shown in TABLE 1.

TABLE 1

| Sample No. | Composition of Ti-based alloy (wt %) | Particulates | Oxidation test temperature (° C.) | Oxidation test weight gain (g/m$^2$) |
|---|---|---|---|---|
| | | Examples of the present invention | | |
| 1 | Ti-6Al-4V | $SiO_2$ | 700 | 6.4 |
| 2 | Ti-6Al-4V | $Cr_2O_3$ | 700 | 7.2 |
| 3 | Ti-6Al-4V | $Y_2O_3$ | 700 | 8.2 |
| 4 | Ti-6Al-4V | $ZrO_2$ | 700 | 7.5 |
| 5 | Ti-6Al-4V | $Nb_2O_5$ | 700 | 7.7 |
| 6 | Ti-6Al-4V | $MoO_3$ | 700 | 8.2 |
| 7 | Ti-6Al-4V | $La_2O_3$ | 700 | 8.4 |
| 8 | Ti-6Al-4V | $CeO_2$ | 700 | 7.4 |
| 9 | Ti-6Al-4V | $HfO_2$ | 700 | 6.8 |
| 10 | Ti-6Al-4V | $Ta_2O_5$ | 700 | 5.6 |
| 11 | Ti-6Al-4V | $WO_3$ | 700 | 6.2 |
| 12 | Ti-6Al-45n-4Zr-1Nb-1Mo-0.2Si | $SiO_2$ | 800 | 16.2 |
| 13 | Ti-6Al-45n-4Zr-1Nb-1Mo-0.2Si | $Cr_2O_3$ | 800 | 17.0 |
| 14 | Ti-6Al-45n-4Zr-1Nb-1Mo-0.2Si | $Y_2O_3$ | 800 | 18.0 |
| 15 | Ti-6Al-45n-4Zr-1Nb-1Mo-0.2Si | $ZrO_2$ | 800 | 18.4 |
| 16 | Ti-6Al-45n-4Zr-1Nb-1Mo-0.2Si | $Nb_2O_5$ | 800 | 17.5 |
| 17 | Ti-6Al-45n-4Zr-1Nb-1Mo-0.2Si | $MoO_3$ | 800 | 18.6 |
| 18 | Ti-6Al-45n-4Zr-1Nb-1Mo-0.2Si | $La_2O_3$ | 800 | 16.5 |
| 19 | Ti-6Al-45n-4Zr-1Nb-1Mo-0.2Si | $CeO_2$ | 800 | 16.3 |
| 20 | Ti-6Al-45n-4Zr-1Nb-1Mo-0.2Si | $HfO_2$ | 800 | 16.2 |

TABLE 1-continued

| Sample No. | Composition of Ti-based alloy (wt %) | Particulates | Oxidation test temperature (° C.) | Oxidation test weight gain (g/m$^2$) |
|---|---|---|---|---|
| 21 | Ti-6Al-45n-4Zr-1Nb-1Mo-0.2Si | $Ta_2O_5$ | 800 | 15.1 |
| 22 | Ti-6Al-45n-4Zr-1Nb-1Mo-0.2Si | $WO_3$ | 800 | 15.9 |
| | Comparative example | | | |
| 23 | Ti-6Al-4V | — | 700 | 61.2 |
| 24 | Ti-6Al-45n-4Zr-1Nb-1Mo-0.2Si | — | 800 | 45.6 |

As is apparent from TABLE 1, in comparative examples Nos. 23 and 24, each having no particulate on a surface thereof, the weight gain is remarkably great, as compared to those of the samples Nos. 1 through 22, which were formed with the method in accordance with the present invention. This result shows that the application of oxide particulates to which mechanical energy is applied, to the surface of the Ti-based alloy is effective.

Second Embodiment

Ingots of various Ti-based alloys having chemical compositions shown in TABLE 2 were formed by melting, and cut to prepare test pieces, each having a plate-like configuration with dimensions of 15×10×3 (mm), similarly to the first embodiment.

Then, the surface of each test piece was ground with a SiC paper of No. 1500, and degreased with acetone.

Particulates of metal or alloy of Al, Si, Cr, Y, Zr, Nb, Mo, La, Ce, Hf, Ta, W, $NbSi_2$, $TaSi_2$, $WSi_2$, $MoSi_2$ and $ZrSi_2$, each having a particle diameter of 5 to 200 $\mu$m, were prepared, and shot-blasting treatment similar to that of the first embodiment was performed using the prepared particulates. Then, oxidation test was performed at 700° C. or 800° C. The test results are shown in TABLE 2. Due to this treatment, a protective coating adhered to each test piece by about 5 $\mu$m.

More specifically, particulates were sprayed onto surfaces of plate-like test pieces Ti-based alloy with dimensions of 15×10×3 mm repeatedly from a nozzle having a diameter of 5 mm with the compressed air of a spraying pressure of 4 kgf/cm$^2$ by means of a device for use in shot-blasting. The distance from a tip end of the nozzle to each test piece was 100 mm and the treatment time was 1 minute.

TABLE 2

| Sample No. | Composition of Ti-based alloy (wt %) | Particulates | Oxidation test temperature (° C.) | Oxidation test weight gain (g/m$^2$) |
|---|---|---|---|---|
| | Examples of the present invention | | | |
| 25 | Ti-6Al-4V | Si | 700 | 6.4 |
| 26 | Ti-6Al-4V | Cr | 700 | 8.2 |
| 27 | Ti-6Al-4V | Y | 700 | 6.5 |
| 28 | Ti-6Al-4V | Zr | 700 | 7.2 |
| 29 | Ti-6Al-4V | Nb | 700 | 7.2 |
| 30 | Ti-6Al-4V | Mo | 700 | 9.6 |
| 31 | Ti-6Al-4V | La | 700 | 8.2 |
| 32 | Ti-6Al-4V | Ce | 700 | 8.7 |
| 33 | Ti-6Al-4V | Ta | 700 | 7.7 |
| 34 | Ti-6Al-4V | W | 700 | 6.8 |
| 35 | Ti-6Al-4V | $TaSi_2$ | 700 | 6.2 |
| 36 | Ti-6Al-4V | $NbSi_2$ | 700 | 5.9 |
| 37 | Ti-6Al-4V | $WSi_2$ | 700 | 5.8 |
| 38 | Ti-6Al-4Sn-4Zr-1Nb-1Mo-0.2Si | Si | 800 | 15.9 |
| 39 | Ti-6Al-45n-4Zr-1Nb-1Mo-0.2Si | Cr | 800 | 18.5 |
| 40 | Ti-6Al-45n-4Zr-1Nb-1Mo-0.2Si | Y | 800 | 17.7 |
| 41 | Ti-6Al-45n-4Zr-1Nb-1Mo-0.2Si | Zr | 700 | 19.2 |
| 42 | Ti-6Al-4Sn-4Zr-1Nb-1Mo-0.2Si | Nb | 800 | 18.7 |
| 43 | Ti-6Al-4Sn-4Zr-1Nb-1Mo-0.2Si | Mo | 800 | 18.6 |
| 44 | Ti-6Al-45n-4Zr-1Nb-1Mo-G.2Si | La | 800 | 16.5 |
| 45 | Ti-6Al-45n-4Zr-1Nb-1Mo-0.2Si | Ce | 800 | 16.3 |
| 46 | Ti-6Al-45n-4Zr-1Nb-1Mo-0.2Si | Ta | 800 | 16.2 |
| 47 | Ti-6Al-45n-4Zr-1Nb-1Mo-0.2Si | W | 800 | 18.6 |
| 48 | Ti-6Al-45n-4Zr-1Nb-1Mo-0.2Si | $TaSi_2$ | 800 | 16.5 |
| 49 | Ti-6Al-45n-4Zr-1Nb-1Mo-0.2Si | $NbSi_2$ | 800 | 16.3 |
| 50 | Ti-6Al-45n-4Zr-1Nb-1Mo-0.2Si | $WSi_2$ | 800 | 16.2 |
| 51 | Ti-6Al-2.7Sn-4Zr-0.4Mo-0.45Si | $MoSi_2$ | 800 | 20.2 |
| 52 | Ti-6Al-2.7Sn-4Zr-0.4Mo-0.45Si | $NbSi_2$ | 800 | 25.1 |
| 53 | Ti-6Al-2.7Sn-4Zr-0.4Mo-0.45Si | $WSi_2$ | 800 | 27.2 |

TABLE 2-continued

| Sample No. | Composition of Ti-based alloy (wt %) | Particulates | Oxidation test temperature (° C.) | Oxidation test weight gain (g/m$^2$) |
|---|---|---|---|---|
| 54 | Ti-6Al-2.7Sn-4Zr-0.4Mo-0.45Si | $ZrSi_2$ | 800 | 32.4 |
| 55 | Ti-6Al-2.7Sn-4Zr-0.4Mo-0.45Si | Al + $MoSi_2$ | 800 | 10.4 |
| 56 | Ti-6Al-2.7Sn-4Zr-0.4Mo-0.45Si | Al + $NbSi_2$ | 800 | 15.3 |
| | Comparative example | | | |
| 57 | Ti-6Al-4V | — | 700 | 61.2 |
| 58 | Ti-6Al-4Sn-4Zr-1Nb-1Mo-0.2Si | — | 800 | 45.6 |
| 59 | Ti-6Al-2.7Sn-4Zr-0.4Mo-0.45Si | — | 800 | 81.2 |

As is apparent from TABLE 2, in comparative examples Nos. 57 through 59, each having no particulate on a surface thereof, the weight gain is remarkably great, as compared to the samples Nos. 25 through 56, which were formed with the method in accordance with the present invention. This result shows that the application of metal particulates to which mechanical energy is applied, to the surface of the Ti-based alloy is effective.

Third Embodiment

Ingots of various Ti-based alloys having chemical compositions shown in TABLE 3 were formed by melting, and cut to prepare test pieces, each having a plate-like configuration with dimensions of 15×10×3 (mm), similarly to the first embodiment.

Then, the surface of each test piece was ground with a SiC paper of No. 1500, and degreased with acetone.

Figure 2:
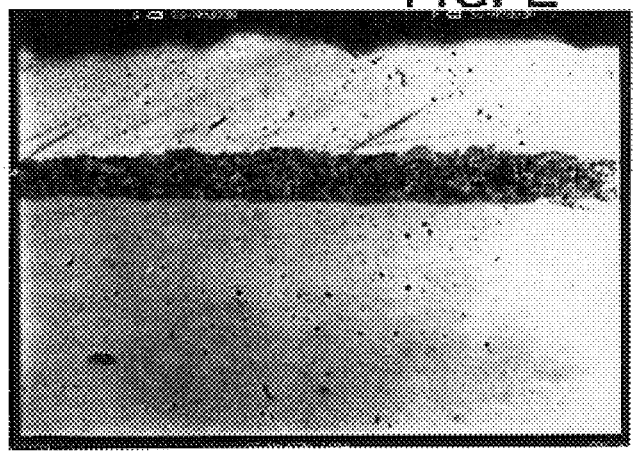
FIG. 2 is a diagram illustrating the section of the vicinity of a surface of the sample No. 60.

The micrograph of 1000 magnification of the section near the surface of the member of the Ti-based alloy of the sample No. 60, which uses $MoSi_2$ powder as the particulates, is shown in FIG. 2. As is shown in FIG. 2, a coating was formed to the depth of about 10 $\mu$m from the surface of a resultant member. In the section shown in FIG. 2, a Ni-plated layer was formed over the surface of the protective coating to prevent it from running down the Ti-based alloy.

Then, the oxidation resistance test was conducted at 800° C., and the weight gain due to 200 hours-oxidation was measured. The measurement results are shown in TABLE 3.

TABLE 3

| Sample No. | Composition of Ti-based alloy (wt %) | Particulates | Oxidation test temperature (° C.) | Oxidation test weight gain (g/m$^2$) |
|---|---|---|---|---|
| | Examples of the present invention | | | |
| 60 | Ti-6Al-2.7Sn-4Zr-0.4Mo-0.45Si | $MoSi_2$ | 800 | 9.8 |
| 61 | Ti-6Al-2.7Sn-4Zr-0.4Mo-0.45Si | $NbSi_2$ | 800 | 10.2 |
| 62 | Ti-6Al-2.7Sn-4Zr-0.4Mo-0.45Si | $WSi_2$ | 800 | 13.5 |
| 63 | Ti-6Al-2.7Sn-4Zr-0.4Mo-0.45Si | $ZrSi_2$ | 800 | 15.2 |
| | Comparative example | | | |
| 64 | Ti-6Al-2.75n-4Zr-0.4Mo-0.45Si | — | 800 | 81.2 |

The surface treatment of each test piece was performed with a planetary ball mill as the means of applying mechanical energy.

To apply mechanical energy with the planetary ball mill, the Ti-based alloy, particulates and hard balls were put in a rotatable container, and the planetary ball mill was driven to strike the particulates against the surface of the Ti-based alloy repeatedly. The planetary ball mill during rotation is shown in FIG. 1.

More specifically, a Ti-based alloy 1, particulates 2, each having a particle diameter of 5 to 20 $\mu$m, and hard balls 3, each being composed of $ZrO_2$ and having a particle diameter of 1 mm, were put in a cylindrical rotatable container having an inner diameter of 10 mm and height of 10 mm, and placed on a rotatable bed. And the container was rotated at 750 rpm for 5 minutes along with the bed, thus applying mechanical energy to the Ti-based alloy 1, particulates 2 and hard balls 3 within the rotatable container 4. The application of mechanical energy was performed in the air atmosphere.

As is apparent from TABLE. 3, in the comparative example No. 64 having no particulate, the weight gain due to oxidation is remarkably great, as compared to those of the samples Nos. 60 through 63. These results show that the application of metal particulates to which mechanical energy is applied, to the surface of the Ti-based alloy is effective.

Fourth Embodiment

The surface of each of test pieces of stainless steel JIS SUS 403 was ground with a SiC paper of No. 1500, and degreased with acetone.

Powders of $NbSi_2$, MoSi2, Si and Cr, each having a particle diameter of 75 $\mu$m or less, were prepared, and the surface of each test piece was subjected to shot-blasting treatment by spraying the prepared powders under the spraying pressure of 4 kgf/cm$^2$, which corresponds to the spraying rate of 100 m/sec. Due to this treatment, particulates adhered to the surface of each test piece by about 5 $\mu$m.

More specifically, by jetting the particulates from a nozzle of a diameter of 5 mm with compressed air of which the spraying pressure is 4 kgf/cm$^2$ by means of a device for use in shot-blasting, the particulates were repeatedly sprayed onto the surface of each plate-like test piece of SUS 403 having dimensions of 16×13×2 mm. The distance from a tip end of the nozzle to each test piece was about 100 mm and the treatment time was 1 minute.

Then, the oxidation resistance of each plate-like test piece thus treated was evaluated by the following method. The test pieces were heated at 950° C. for 100 hours in the air with the resistance heating electric furnace. During testing, each test piece was heated within a crucible of $Al_2O_3$. Then, each test piece was collected along with peeled coating, and the weight gain due to oxidation was measured to evaluate the oxidation resistance thereof. The evaluation results are shown in TABLE 4.

TABLE 4

| | Sample No. | Particulates | Weight gain due to oxidation (mg/cm$^2$) |
|---|---|---|---|
| Examples of the present invention | 65 | $NbSi_2$ | 2.0 |
| | 66 | $MoSi_2$ | 2.5 |
| | 67 | Si | 13.4 |
| | 68 | Cr | 8.7 |
| Comparative example | 69 | — | 24.5 |

As is apparent from TABLE 4, in the samples Nos. 65 through 68 wherein particulates were applied to SUS 403, the weight gain due to oxidation is small, as compared to that of the comparative example No. 69 which has no particulate. This result shows that the samples Nos. 65 through 68 are excellent in oxidation resistance. Particularly, in the samples Nos. 65 and 66, each using an alloy with silicon as the particulates, the weight gain due to oxidation is especially small so that protective coatings exhibiting excellent oxidation resistance, as compared to the cases using a simple substance of silicon or chromium as the particulates, can deformed.

Fifth Embodiment

Powders of $NbSi_2$, $MoSi_2$, $WSi_2$, $ZrSi_2$, $CrSi_2$, Si and Cr, each having a particle diameter of 75 $\mu$m or less, were prepared, and a surface of each test piece was subjected to shot-blasting by spraying the prepared powder under the spraying pressure of 4 kgf/cm$^2$ which corresponds to the spraying rate of 100 m/sec. Due to this treatment, particulates adhere to the surface of each test piece by about 5 $\mu$m.

More specifically, by jetting the particulates from a nozzle of a diameter of 5 mm with compressed air of which the spraying pressure is 4 kgf/cm$^2$ by means of a device for use in shot-blasting, the particulates were repeatedly sprayed onto the surface of each plate-like test piece of SUS 304 having dimensions of 15×10×2 mm. The distance from a tip end of the nozzle to each test piece was about 100 mm and the treatment time was 1 minute.

Figure 3:
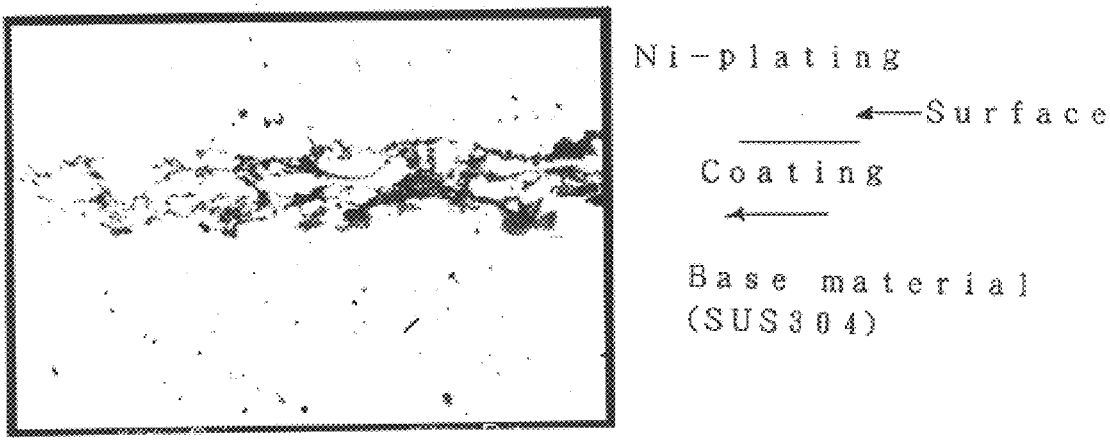
FIG. 3 is a diagram illustrating the section of the vicinity of a surface of the sample No. 74.

Next, the section structure near the surface of the sample No. 74 which uses $ZrSi_2$ as the particulates was observed. The section structure was shown in FIG. 3. As shown in FIG. 3, a coating wherein at least one part of the particulates were connected to each other was formed to the depth of about 10 $\mu$m from the surface of SUS 304.

Then, the oxidation resistance of each plate-like test piece thus treated was evaluated by the following method. The test pieces were heated at 950° C. for 100 hours in the air by means of the resistance heating electric furnace. During testing, each test piece was heated within a crucible of $Al_2O_3$. Then, each test piece was collected along with peeled coating, and the weight gain due to oxidation was measured to evaluate the oxidation resistance thereof. The evaluation results are shown in TABLE 5.

TABLE 5

| | Sample No. | Particulates | Weight gain due to oxidation (mg/cm$^2$) |
|---|---|---|---|
| Examples of the present invention | 70 | $WSi_2$ | 0.8 |
| | 71 | $NbSi_2$ | 1.6 |
| | 72 | $CrSi_2$ | 1.5 |
| | 73 | $MoSi_2$ | 2.2 |
| | 74 | $ZrSi_2$ | 1.2 |
| | 75 | Si | 9.8 |
| | 76 | Cr | 6.5 |
| Comparative example | 77 | — | 20.0 |

As is apparent from TABLE 5, in the samples Nos. 70 through 76 wherein particulates were applied to SUS 304, the weight gain due to oxidation is small, as compared to that of the comparative example No. 77 which was not subjected to such surface treatment. This result shows that these samples Nos. 70 through 76 exhibit excellent oxidation resistance. Particularly in the samples Nos. 70 and 74 using alloys with silicon as the particulates, the weight gain due to oxidation is especially small so that protective coating exhibiting excellent oxidation resistance, as compared to the cases using a simple substance of silicon or chromium as the particulates, can be formed.

Sixth Embodiment

The surface treatment similar to that of the fourth embodiment except that the test pieces were composed of nickel-based alloy of JIS NCF751 was performed, and the oxidation resistance thereof was evaluated. The oxidation condition was 1100° C. and 100 hours. The evaluation results are shown in TABLE 6.

TABLE 6

| | Sample No. | Particulates | Weight gain due to oxidation (mg/cm$^2$) |
|---|---|---|---|
| Examples of the present invention | 78 | $NbSi_2$ | 0.6 |
| | 79 | $HfSi_2$ | 0.8 |
| | 80 | Si | 3.8 |
| | 81 | Cr | 2.3 |
| Comparative example | 82 | — | 34.9 |

As is apparent from TABLE 6, in the samples Nos. 78 through 81 wherein particulates were applied to NCF 751, the weight gain due to oxidation is small, as compared to that of the comparative example No. 82 which was not subjected to such surface treatment. This result shows that these samples Nos. 78 through 81 exhibit excellent oxidation resistance. Particularly, in the samples Nos. 78 and 79 using alloys with silicon as the particulates, the weight gain due to oxidation is small so that protective coatings exhibiting excellent oxidation resistance, as compared to the cases using a simple substance of silicon or chromium as the particulates, can be formed.

Seventh Embodiment

The surface treatment similar to that of the fourth embodiment except that the test pieces were composed of heat-resistant steel of JIS SCH 12 was performed, and the oxidation resistance thereof was evaluated. The oxidation condition was 900° C. and 100 hours. The evaluation results are shown in TABLE 7.

TABLE 7

| | Sample No. | Particulates | Weight gain due to oxidation (mg/cm$^2$) |
|---|---|---|---|
| Examples of the present invention | 83 | $NbSi_2$ | 0.6 |
| | 84 | $MoSi_2$ | 0.9 |
| | 85 | Si | 2.2 |
| | 86 | Cr | 1.8 |
| Comparative example | 87 | — | 12.0 |

As is apparent from TABLE 7, in the samples Nos. 83 through 86 wherein particulates were applied to SCH 12, the weight gain due to oxidation is small, as compared to that of the comparative example No. 87 which was not subjected to such surface treatment. This result shows that these samples Nos. 83 through 86 exhibit excellent oxidation resistance. Particularly, in the samples Nos. 83 and 84 using alloys with silicon as the particulates, the weight gain due to oxidation is small so that protective coatings exhibiting excellent oxidation resistance, as compared to the cases using a simple substance of silicon or chromium as the particulates, can be formed.

Eighth Embodiment

The surface treatment similar to that of the fourth embodiment except that the test pieces were composed of JIS FCD (niresist cast iron) was performed, and the oxidation resistance thereof was evaluated. The oxidation condition was 850° C. and 100 hours. The evaluation results are shown in TABLE 8.

TABLE 8

| | Sample No. | Particulates | Weight gain due to oxidation (mg/cm$^2$) |
|---|---|---|---|
| Examples of the present invention | 88 | $NbSi_2$ | 2.8 |
| | 89 | $TaSi_2$ | 3.3 |
| | 90 | $CrSi_2$ | 3.9 |
| | 91 | Cr | 9.6 |
| Comparative example | 92 | — | 145.5 |

As is apparent from TABLE 8, in the samples Nos. 88 through 91 wherein particulates were applied to niresist cast iron, the weight gain due to oxidation is small, as compared to that of the comparative example No. 92 which was not subjected to such surface treatment. This result shows that these samples NOS. 88 through 91 exhibit excellent oxidation resistance. Particularly, in the samples Nos. 88 through 90 using alloys with silicon as the particulates, the weight gain due to oxidation is small so that protective coatings exhibiting excellent oxidation resistance, as compared to the case using a simple substance of chromium as the particulates, can be formed.

Ninth Embodiment

The surface treatment similar to that of the fourth embodiment except that the test pieces were composed of JIS SS41 was performed, and the oxidation resistance thereof was evaluated. The oxidation condition was 550° C. and 100 hours. The evaluation results are shown in TABLE 9.

TABLE 9

| | Sample No. | Particulates | Weight gain due to oxidation (mg/cm$^2$) |
|---|---|---|---|
| Examples of the | 93 | $NbSi_2$ | 1.9 |

TABLE 9-continued

| | Sample No. | Particulates | Weight gain due to oxidation (mg/cm$^2$) |
|---|---|---|---|
| present invention | 94 | $WSi_2$ | 2.0 |
| | 95 | $CrSi_2$ | 2.8 |
| | 96 | Cr | 4.7 |
| Comparative example | 97 | — | 76.8 |

As is apparent from TABLE 9, in the samples Nos. 93 through 96 wherein particulates were applied to SS41, the weight gain due to oxidation is small, as compared to that of the comparative example No. 97 which was not subjected to such surface treatment. This result shows that these samples Nos. 93 through 96 exhibit excellent oxidation resistance. Particularly, in the samples Nos. 93 through 95 using alloys with silicon as the particulates, the weight gain due to oxidation is small so that protective coatings exhibiting excellent oxidation resistance, as compared to the case using a simple substance of chromium as the particulates, can be formed.

With the method of producing metal members in accordance with the present invention, protective coatings can be formed in the surfaces of the metal members composed of Ti-based alloy and those composed of iron-based alloy and nickel-based alloy. These protective coatings can prevent the proceeding of the oxidation of the metal members in a high temperature-oxidation atmosphere, namely, prevent the formation of oxides in the protective coatings due to the oxidation of elements composing the metal members, and consequently, serve to the remarkable improvement of the oxidation resistance of the metal members.

While the invention has been described in connection with what are considered presently to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A method comprising forming a protective coating on a surface of a metallic part of a Ti-based alloy comprising titanium (Ti) and less than 9 wt % of aluminum (Al), by applying mechanical energy to particulates consisting essentially of at least one Si alloy selected from the group consisting of $CrSi_2$, $NbSi_2$, $MoSi_2$, $WSi_2$, $ZrSi_2$ and $HfSi_2$, in a direction toward said surface, wherein said protective coating contains at least a part of said particulates dispersed in a matrix of said Ti-based alloy, some of which dispersed particulates being connected to each other.

2. A method as claimed in claim 1, wherein said Ti-based alloy contains 1 wt % or more and less than 9 wt % of Al.

3. A method as claimed in claim 1, wherein said particulates have an average particle diameter of 5 to 300 $\mu$m.

4. A method as claimed in claim 1, wherein said Ti-based alloy contains 0.5 to 10 wt % of vanadium (V).

5. A method as claimed in claim 1, wherein said Ti-based alloy contains 0.5 to 6.0 wt % of zirconium (Zr).

6. A method as claimed in claim 1, wherein said Ti-based alloy contains 0.5 to 3.0 wt % of molybdenum (Mo).

7. A method as claimed in claim 1, wherein said Ti-based alloy contains 0.5 to 4.5 wt % of niobium (Nb).

8. A method as claimed in claim 1, wherein said Ti-based alloy contains 0.1 to 1.0 wt % of silicon (Si).

9. A method comprising forming a protective coating on a surface of a metallic part of a Ti-based alloy by applying mechanical energy to particulates containing at least one element of yttrium (Y) zirconium (Zr), lanthanum (La), cerium (Ce) and hafnium (Hf) in a direction toward said surface, wherein said protective coating contains at least a part of said particulates dispersed in a matrix of said Ti-based alloy, some of which dispersed particulates being connected to each other.

10.c A method as claimed in claim 9, wherein said Ti-based alloy contains less than 9 wt % of Al.

11. A method as claimed in claim 9, wherein said particulates have an average particle diameter of 5 to 300 $\mu$m.

12. A method as claimed in claim 9, wherein said Ti-based alloy contains 0.5 to 10 wt % of vanadium (V).

13. A method as claimed in claim 9, wherein said Ti-based alloy contains 0.5 to 6.0 wt % of zirconium (Zr).

14. A method as claimed in claim 9, wherein said Ti-based alloy contains 0.5 to 3.0 wt % of molybdenum (Mo).

15. A method as claimed in claim 9, wherein said Ti-based alloy contains 0.5 to 4.5 wt % of niobium (Nb).

16. A method as claimed in claim 9, wherein said Ti-based alloy contains 0.1 to 1.0 wt % of silicon (Si).

17. A method comprising forming a protective coating with an oxidation resistance on a surface of a metallic part of an iron-based alloy or a nickel-based alloy by applying mechanical energy to particulates consisting essentially of at least one Si alloy selected from the group consisting of $CrSi_2$, $NbSi_2$, $MoSi_2$, $WSi_2$, $ZrSi_2$ and $HfSi_2$, wherein said protective coating contains at least a part of said particulates dispersed in a matrix of said alloy, some of which dispersed particulates being connected to each other.

* * * * *